US010964301B2

(12) United States Patent
Zhang

(10) Patent No.: US 10,964,301 B2
(45) Date of Patent: Mar. 30, 2021

(54) METHOD AND APPARATUS FOR CORRECTING DELAY BETWEEN ACCOMPANIMENT AUDIO AND UNACCOMPANIED AUDIO, AND STORAGE MEDIUM

(71) Applicant: GUANGZHOU KUGOU COMPUTER TECHNOLOGY CO., LTD., Guangzhou (CN)

(72) Inventor: Chaogang Zhang, Guangzhou (CN)

(73) Assignee: GUANGZHOU KUGOU COMPUTER TECHNOLOGY CO., LTD., Guangzhou (CN)

( * ) Notice: Subject to any disclaimer, the term of this patent is extended or adjusted under 35 U.S.C. 154(b) by 0 days.

(21) Appl. No.: 16/627,954

(22) PCT Filed: Nov. 26, 2018

(86) PCT No.: PCT/CN2018/117519
§ 371 (c)(1),
(2) Date: Dec. 31, 2019

(87) PCT Pub. No.: WO2019/237664
PCT Pub. Date: Dec. 19, 2019

(65) Prior Publication Data

US 2020/0135156 A1 Apr. 30, 2020

(30) Foreign Application Priority Data

Jun. 11, 2018 (CN) ..... 201810594183.2

(51) Int. Cl.
*G10H 1/36* (2006.01)
*G10H 1/00* (2006.01)

(52) U.S. Cl.
CPC ..... *G10H 1/366* (2013.01); *G10H 1/0008* (2013.01); *G10H 2210/005* (2013.01); *G10H 2210/056* (2013.01); *G10H 2210/066* (2013.01)

(58) Field of Classification Search
CPC ..... G10H 1/0008; G10H 1/366; G10H 2210/005; G10H 2210/066; G10H 2210/056
See application file for complete search history.

(56) References Cited

U.S. PATENT DOCUMENTS 5,315,060 A * 5/1994 Paroutaud ..... G10F 1/00 84/11
5,648,627 A * 7/1997 Usa ..... G10H 1/0556 84/600

(Continued)

FOREIGN PATENT DOCUMENTS

CN 103310776 A 9/2013
CN 104885153 A 9/2015

(Continued)

OTHER PUBLICATIONS

International search report and Written Opinion in PCT application No. PCT/CN2018/117519 dated Feb. 27, 2019.

(Continued)

*Primary Examiner* — Jeffrey Donels
(74) *Attorney, Agent, or Firm* — Knobbe Martens Olson & Bear LLP

(57) ABSTRACT

A method and apparatus for correcting a delay between accompaniment audio and unaccompanied audio, and a storage medium are provided. The method includes: acquiring original audio of a target song, and extracting original vocal audio from the original audio; determining a first delay between the original vocal audio and the unaccompanied audio, and determining a second delay between the accom- (Continued)

paniment audio and the original audio; and correcting a delay between the accompaniment audio and the unaccompanied audio based on the first delay and the second delay. Thus, the correction efficiency of the delay between accompaniment audio and unaccompanied audio is improved, and correction mistakes possibly caused by human factors are eliminated, thereby improving the accuracy.

20 Claims, 3 Drawing Sheets

(56) References Cited

U.S. PATENT DOCUMENTS

| | | | | |
|---|---|---|---|---|
| 5,808,219 | A * | 9/1998 | Usa | G10H 1/00 84/477 B |
| 6,353,174 | B1 * | 3/2002 | Schmidt | G10H 1/0058 709/200 |
| 6,482,087 | B1 * | 11/2002 | Egozy | A63F 13/12 463/7 |
| 6,898,729 | B2 * | 5/2005 | Virolainen | G10H 1/0066 714/4.1 |
| 7,333,865 | B1 | 2/2008 | Covell et al. | |
| 8,653,349 | B1 * | 2/2014 | White | G10H 1/0025 84/600 |
| 10,395,666 | B2 * | 8/2019 | Cook | G10L 13/0335 |
| 2002/0005109 | A1 * | 1/2002 | Miller | G10H 1/0058 84/609 |
| 2002/0134222 | A1 * | 9/2002 | Tamura | G06F 12/121 84/622 |
| 2003/0094093 | A1 * | 5/2003 | Smith | G10H 1/0058 84/609 |
| 2003/0164084 | A1 * | 9/2003 | Redmann | G10H 1/0058 84/615 |
| 2007/0028750 | A1 * | 2/2007 | Darcie | G10H 1/0058 84/625 |
| 2007/0039449 | A1 * | 2/2007 | Redmann | G10H 1/0058 84/609 |
| 2007/0076891 | A1 * | 4/2007 | Cho | G10H 1/0091 381/1 |
| 2007/0245881 | A1 * | 10/2007 | Egozy | G10H 1/0016 84/609 |
| 2008/0113797 | A1 * | 5/2008 | Egozy | A63F 13/814 463/35 |
| 2009/0178543 | A1 * | 7/2009 | Lee | H04N 21/439 84/610 |
| 2009/0320669 | A1 * | 12/2009 | Piccionelli | G10H 1/0058 84/609 |
| 2015/0143976 | A1 * | 5/2015 | Katto | G10H 7/00 84/602 |
| 2017/0110102 | A1 * | 4/2017 | Colafrancesco | G10H 1/361 |
| 2017/0140745 | A1 | 5/2017 | Nayak et al. | |
| 2018/0232446 | A1 * | 8/2018 | Zhu | G06F 16/683 |
| 2019/0138263 | A1 * | 5/2019 | Kong | G10H 1/361 |
| 2020/0043518 | A1 * | 2/2020 | Jansson | G10L 21/10 |

FOREIGN PATENT DOCUMENTS

| | | | |
|---|---|---|---|
| CN | 104978982 | A | 10/2015 |
| CN | 106251890 | A | 12/2016 |
| CN | 107591149 | A | 1/2018 |
| CN | 107862093 | A | 3/2018 |
| CN | 108711415 | A | 10/2018 |
| TW | 200903452 | A | 1/2009 |

OTHER PUBLICATIONS

Alain de CheveignéYIN, a fundamental frequency estimator for speech and music. The Journal of the Acoustical Society of America 111, 1917 (2002).

M. Mauch and S. Dixon, "pYIN: A Fundamental Frequency Estimator Using Probabilistic Threshold Distributions", in Proceedings of the IEEE International Conference on Acoustics, Speech, and Signal Processing (ICASSP 2014), 2014.

Extended European Search Report of counterpart EP application No. 18922771.3—14 pages dated Jul. 10, 2020.

Sebastian et al., "Group Delay based Music Source Separation using Deep Recurrent Neural Networks", 2016 International Conference on Signal Processing and Communications (SPCOM), IEEE, Extracting the vocal part from a song.; paragraph [0001], figure 1-5 pages (Jun. 12, 2016).

* cited by examiner

METHOD AND APPARATUS FOR CORRECTING DELAY BETWEEN ACCOMPANIMENT AUDIO AND UNACCOMPANIED AUDIO, AND STORAGE MEDIUM

CROSS-REFERENCE TO RELATED APPLICATION

This application claims priority to Chinese Patent Application No. 201810594183.2, filed on Jun. 11, 2018 and entitled "METHOD AND APPARATUS FOR CORRECTING DELAY BETWEEN ACCOMPANIMENT AND UNACCOMPANIED SOUND, AND STORAGE MEDIUM", the entire contents of which are incorporated herein by reference.

TECHNICAL FIELD

The present disclosure relates to a method and apparatus for correcting a delay between accompaniment audio and unaccompanied audio, and a storage medium.

BACKGROUND

At present, in consideration of demands of different users, different forms of audios, such as original audios, accompaniment audios and unaccompanied audios of songs may be stored in a song library of a music application. The original audio refers to original audio that contains both an accompaniment and vocals. The accompaniment audio refers to audio that does not contain the vocals. The unaccompanied audio refers to audio that does not contain the accompaniment and only contains the vocals. A delay is generally present between the accompaniment audio and the unaccompanied audio of the stored song due to factors such as different versions of the stored audio or different version management modes of the audio.

SUMMARY

Embodiments of the present disclosure provide a method and apparatus for correcting a delay between accompaniment audio and unaccompanied audio and a computer-readable storage medium.

In a first aspect, a method for correcting a delay between accompaniment audio and unaccompanied audio is provided. The method includes:

acquiring original audio of a target song, and extracting original vocal audio from the original audio;

determining a first delay between the original vocal audio and the unaccompanied audio, and determining a second delay between the accompaniment audio and the original audio; and correcting a delay between the accompaniment audio and the unaccompanied audio based on the first delay and the second delay.

Optionally, determining a first delay between the original vocal audio and the unaccompanied audio includes:

acquiring a pitch value corresponding to each of a plurality of audio frames contained in the original vocal audio, and ranking a plurality of acquired pitch values of the original vocal audio according to a sequence of the plurality of audio frames contained in the original vocal audio to obtain a first pitch sequence;

acquiring a pitch value corresponding to each of a plurality of audio frames contained in the unaccompanied audio, and ranking a plurality of acquired pitch values of the unaccompanied audio according to a sequence of the plurality of audio frames contained in the unaccompanied audio to obtain a second pitch sequence;

determining a first correlation function curve based on the first pitch sequence and the second pitch sequence; and determining the first delay between the original vocal audio and the unaccompanied audio based on a first peak detected on the first correlation function curve.

Optionally, determining a first correlation function curve based on the first pitch sequence and the second pitch sequence includes:

determining, based on the first pitch sequence and the second pitch sequence, a first correlation function model as illustrated by the following formula:

$$c(t) = \sum_{n=-N}^{N} x(n)y(n-t),$$

wherein N is a number of pitch values, N is less than or equal to a number of pitch values contained in the first pitch sequence and N is less than or equal to a number of pitch values contained in the second pitch sequence, x(n) is an $n^{th}$ pitch value in the first pitch sequence, y(n−t) is an $(n-t)^{th}$ pitch value in the second pitch sequence, and t is a time offset between the first pitch sequence and the second pitch sequence; and determining the first correlation function curve based on the first correlation function model.

Optionally, determining a second delay between the accompaniment audio and the original audio includes:

acquiring a plurality of audio frames contained in the original audio according to a sequence of the plurality of audio frames contained in the original audio to obtain a first audio sequence;

acquiring a plurality of audio frames contained in the accompaniment audio according to a sequence of the plurality of audio frames contained in the accompaniment audio to obtain a second audio sequence;

determining the second correlation function curve based on the first audio sequence and the second audio sequence; and determining the second delay between the accompaniment audio and the original audio based on a second peak detected on the second correlation function curve.

Optionally, the correcting the delay between the accompaniment audio and the unaccompanied audio based on the first delay and the second delay includes:

determining a delay difference between the first delay and the second delay as a delay between the accompaniment audio and the unaccompanied audio;

deleting audio data in a first period in the accompaniment audio if the delay between the accompaniment audio and the unaccompanied audio indicates that the accompaniment audio is later than the unaccompanied audio, wherein a start moment of the first period is a start moment of the accompaniment audio, and a duration of the first period is equal to a duration of the delay between the accompaniment audio and the unaccompanied audio; and deleting audio data in a second period in the unaccompanied audio if the delay between the accompaniment audio and the unaccompanied audio indicates that the accompaniment audio is earlier than the unaccompanied audio, wherein a start moment of the second period is a start moment of the unaccompanied audio, and a duration of the second period is equal to a duration of the delay between the accompaniment audio and the unaccompanied audio.

In a second aspect, an apparatus for correcting a delay between accompaniment audio and unaccompanied audio is provided. The apparatus includes:

an acquiring module, used to acquire accompaniment audio, unaccompanied audio and original audio of a target song, and extract original vocal audio from the original audio;

a determining module, used to determine a first correlation function curve based on the original vocal audio and the unaccompanied audio, and determine a second correlation function curve based on the original audio and the accompaniment audio; and a correcting module, used to correct a delay between the accompaniment audio and the unaccompanied audio based on the first correlation function curve and the second correlation function curve.

Optionally, the determining module includes:

a first acquiring sub-module, used to acquire a pitch value corresponding to each of a plurality of audio frames contained in the original vocal audio, and rank the plurality of acquired pitch values of the original vocal audio according to a sequence of the plurality of audio frames contained in the original vocal audio to obtain a first pitch sequence, wherein the first acquiring sub-module is further used to acquire a pitch value corresponding to each of a plurality of audio frames contained in the unaccompanied audio, and rank a plurality of acquired pitch values of the unaccompanied audio according to a sequence of the plurality of audio frames contained in the unaccompanied audio to obtain a second pitch sequence; and a first determining sub-module, used to determine the first correlation function curve based on the first pitch sequence and the second pitch sequence.

Optionally, the first determining sub-module is specifically used to:

determine, based on the first pitch sequence and the second pitch sequence, a first correlation function model as illustrated by the following formula:

$$c(t) = \sum_{n=-N}^{N} x(n)y(n-t),$$

wherein N is a number of pitch values, N is less than or equal to a number of pitch values contained in the first pitch sequence and N is less than or equal to a number of pitch values contained in the second pitch sequence, x(n) is an $n^{th}$ pitch value in the first pitch sequence, y(n−t) is an $(n-t)^{th}$ pitch value in the second pitch sequence, and t is a time offset between the first pitch sequence and the second pitch sequence; and determine the first correlation function curve based on the first correlation function model.

Optionally, the correcting module includes:

a detecting sub-module, used to detect a first peak on the first correlation function curve, and detect a second peak on the second correlation function curve;

a third determining sub-module, used to determine a first delay between the original vocal audio and the unaccompanied audio based on the first peak, and determine a second delay between the accompaniment audio and the original audio based on the second peak; and a correcting sub-module, used to correct the delay between the accompaniment audio and the unaccompanied audio based on the first delay and the second delay.

Optionally, the determining module includes:

a second acquiring sub-module, used to acquire a plurality of audio frames contained in the original song audio according to a sequence of the plurality of audio frames contained in the original audio to obtain a first audio sequence;

the second acquiring sub-module, used to acquire a plurality of audio frames contained in the accompaniment audio according to a sequence of the plurality of audio frames contained in the accompaniment audio to obtain a second audio sequence; and a second determining sub-module, used to determine the second correlation function curve based on the first audio sequence and the second audio sequence.

Optionally, the correcting sub-module is used to:

determine a delay difference between the first delay and the second delay as a delay between the accompaniment audio and the unaccompanied audio;

delete audio data in a second period in the unaccompanied audio if the delay between the accompaniment audio and the unaccompanied audio indicates that the accompaniment audio is later than the unaccompanied audio, wherein a start moment of the second period is a start moment of the unaccompanied audio, and a duration of the second period is equal to a duration of the delay between the accompaniment audio and the unaccompanied audio; and delete audio data in a second period in the unaccompanied audio if the delay between the accompaniment audio and the unaccompanied audio indicates that the accompaniment audio is earlier than the unaccompanied audio, wherein a start moment of the second period is a start moment of the unaccompanied audio, and a duration of the second period is equal to a duration of the delay between the accompaniment audio and the unaccompanied audio.

In a third aspect, an apparatus for use in correcting a delay between accompaniment audio and unaccompanied audio is provided. The apparatus includes:

a processor; and a memory used to store a processor-executable instruction, wherein the processor is used to implement any method according to the first aspect when the instruction is executed by the processor.

In a fourth aspect, a computer-readable storage medium storing an instruction is provided. The instruction, when being executed by a processor, implement any method according to the first aspect.

The technical solutions according to the embodiments of the present disclosure at least achieve the following beneficial effects: the accompaniment audio, the unaccompanied audio and the original audio of the target song are acquired, and the original vocal audio is extracted from the original audio; the first correlation function curve is determined based on the original vocal audio and the unaccompanied audio, and the second correlation function curve is determined based on the original audio and the accompaniment audio; and the delay between the accompaniment audio and the unaccompanied audio is corrected based on the first correlation function curve and the second correlation function curve. It can be seen therefrom that in the embodiments of the present disclosure, by processing the accompaniment audio, the unaccompanied audio and the corresponding original audio, the delay between the accompaniment audio and the unaccompanied audio is corrected. Compared with the method for correction by a worker at present, this method saves both labors and time and improves the correction efficiency and also eliminates correction mistakes possibly caused by human factors, thereby improving the accuracy.

DETAILED DESCRIPTION

For clearer descriptions of the objectives, technical solutions, and advantages of the present disclosure, the embodiments of the present disclosure are described in further detail hereinafter with reference to the accompanying drawings.

An application scenario of the present disclosure is briefly introduced firstly before the embodiments of the present disclosure are explained in detail.

Currently, in order to improve the user experience of a user for using a music application, a service provider may add various additional items and functions in the music application. Certain function may need to use accompaniment audio and unaccompanied audio of a song at the same time and synthesizes the accompaniment audio and the unaccompanied audio. However, a delay may be present between the accompaniment audio and the unaccompanied audio of the same song due to different versions of audio or different version management modes of the audio. In this case, the accompaniment audio needs to be firstly aligned with the unaccompanied audio and then the audios are synthesized. A method for correcting a delay between accompaniment audio and unaccompanied audio according to the embodiment of the present disclosure may be used in the above scenario to correct the delay between the accompaniment audio and the unaccompanied audio, thereby aligning the accompaniment audio with the unaccompanied audio.

In related arts, since no information about a time domain and a frequency domain is present prior to a start time of the accompaniment audio and the unaccompanied audio, the delay between the accompaniment audio and the unaccompanied audio is mainly checked and corrected by a staff. Consequently, the correction efficiency is low, and the accuracy is relatively lower.

Figure 1:
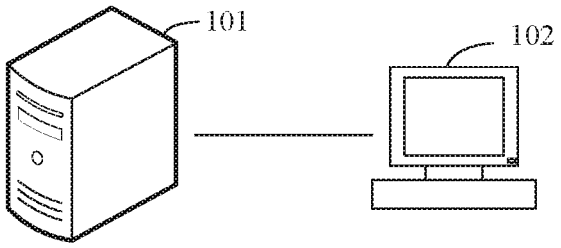
FIG. 1 is a diagram of system architecture of a method for correcting a delay between accompaniment audio and unaccompanied audio according to an embodiment of the present disclosure.

The system architecture involved in the method for correcting the delay between the accompaniment audio and the unaccompanied audio according to the embodiment of the present disclosure is introduced hereinafter. As illustrated in FIG. 1, the system may include a server 101 and a terminal 102. The server 101 and the terminal 102 may communicate with each other.

It should be noted that the server 101 may store song identifiers, original audio, accompaniment audio and unaccompanied audio of a plurality of songs.

When the delay between accompaniment audio and unaccompanied audio is corrected, the terminal 102 may acquire, from the server, accompaniment audio and unaccompanied audio which are to be corrected as well as original audio which corresponds to the accompaniment audio and the unaccompanied audio, and then correct the delay between the accompaniment audio and the unaccompanied audio through the acquired original audio by using the method for correcting the delay between the accompaniment audio and the unaccompanied audio according to the present disclosure. Optionally, in one possible implementation mode, the system may not include the terminal 102. That is, the delay between the accompaniment audio and the unaccompanied audio of each of the plurality of stored songs may be corrected by the server 101 according to the method according to the embodiment of the present disclosure.

It can be known from the above introduction of the system architecture that an execution body in the embodiment of the present disclosure may be the server and may also be the terminal. In the following embodiment, the method for correcting the delay between the accompaniment audio and the unaccompanied audio according to the embodiment of the present disclosure is illustrated in detail below by taking the server as the execution body mainly.

Figure 2:
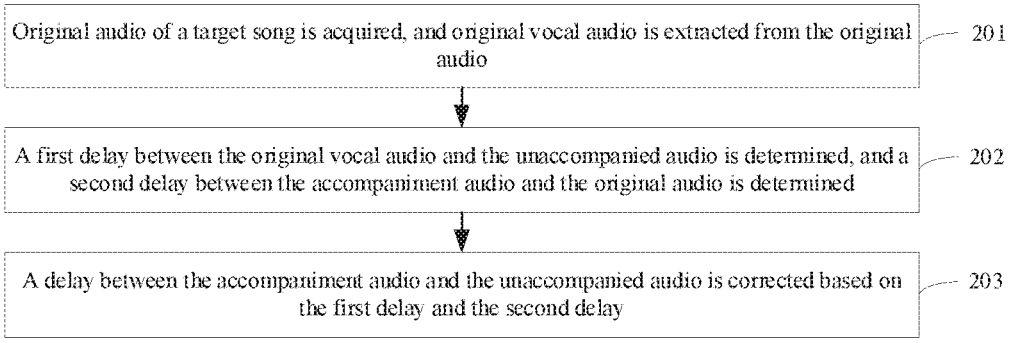
FIG. 2 is a flowchart of a method for correcting a delay between accompaniment audio and unaccompanied audio according to an embodiment of the present disclosure.

FIG. 2 is a flowchart of a method for correcting a delay between accompaniment audio and unaccompanied audio according to the embodiment of the present disclosure. The method may be applied to the server. With reference to FIG. 2, the method may include the following steps.

In step 201, original audio of a target song is acquired, and original vocal audio is extracted from the original audio.

The target song may be any song stored in the server. The accompaniment audio refers to audio that does not contain vocals. The unaccompanied audio refers to vocal audio that does not contain the accompaniment and the original audio refers to original audio that contains both the accompaniment and the vocals.

In step 202, a first delay between the original vocal audio and the unaccompanied audio is determined, and a second delay between the accompaniment audio and the original audio is determined.

In step 203, a delay between the accompaniment audio and the unaccompanied audio is corrected based on the first delay and the second delay.

In the embodiment of the present disclosure, the original audio which corresponds to the accompaniment audio and the unaccompanied audio is acquired and the original vocal audio is extracted from the original audio; the first correlation function curve is determined based on the original vocal audio and the unaccompanied audio, and the second correlation function curve is determined based on the original audio and the accompaniment audio; and the delay between the accompaniment audio and the unaccompanied audio is corrected based on the first correlation function curve and the second correlation function curve. It can be seen therefrom that in the embodiment of the present disclosure, by processing the accompaniment audio, the unaccompanied audio and the corresponding original audio, the delay between the accompaniment audio and the unaccompanied audio is corrected. Compared with the method for correction by a worker at present, this method saves both labors and time and improves the correction efficiency and also eliminates correction mistakes possibly caused by human factors, thereby improving the accuracy.

Figure 3:
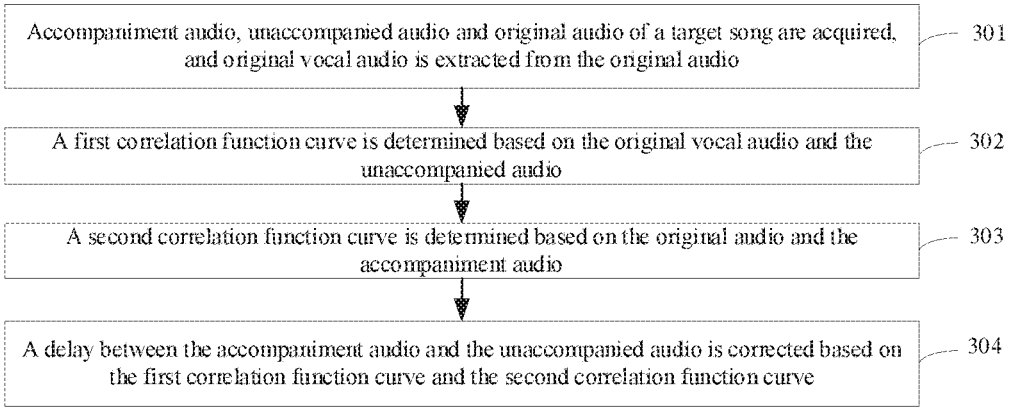
FIG. 3 is a flowchart of a method for correcting a delay between accompaniment audio and unaccompanied audio according to an embodiment of the present disclosure.

FIG. 3 is a flowchart of a method for correcting a delay between accompaniment audio and unaccompanied audio according to the embodiment of the present disclosure. The method may be applied to the server. As illustrated in FIG. 3, the method includes the following steps.

In step 301, accompaniment audio, unaccompanied audio and original audio of a target song are acquired, and original vocal audio is extracted from the original audio.

The target song may be any song in a song library. The accompaniment audio and the unaccompanied audio refer to accompaniment audio and original vocal audio of the target song respectively.

In the embodiment of the present disclosure, the server may firstly acquire the accompaniment audio and the unaccompanied audio which are to be corrected. The server may store a corresponding relationship of a song identifier, an accompaniment audio identifier, an unaccompanied audio identifier and an original audio identifier of each of a plurality of songs. Since the accompaniment audio and the unaccompanied audio which are to be corrected correspond to the same song, the server may acquire the original audio identifier corresponding to the accompaniment audio from the corresponding relationship according to the accompaniment audio identifier of the accompaniment audio and acquire stored original audio according to the original audio identifier. Of course, the server may also acquire the corresponding original audio identifier from the stored corresponding relationship according to the unaccompanied audio identifier of the unaccompanied audio and acquire the stored original audio according to the original audio identifier.

Upon acquiring the original audio, the server may extract the original vocal audio from the original audio through a traditional blind separation mode. The traditional blind separation mode may make reference to the relevant art, which is not repeatedly described in the embodiment of the present disclosure.

Optionally, in one possible implementation mode, the server may also adopt a deep learning method to extract the original vocal audio from the original audio. Specifically, the server may adopt the original audio, the accompaniment audio and the unaccompanied audio of a plurality of songs for training to obtain a supervised convolutional neural network model. Then the server may use the original audio as an input of the supervised convolutional neural network model and output the original vocal audio of the original audio through the supervised convolutional neural network model.

It should be noted that in the embodiment of the present discourse, other types of neural network models may also be adopted to extract original vocal audio from the original audio, which is not limited in the embodiment of the present disclosure.

In step 302, a first correlation function curve is determined based on the original vocal audio and the unaccompanied audio.

After the original vocal audio is extracted from the original audio, the server may determine the first correlation function curve between the original vocal audio and the unaccompanied audio based on the original vocal audio and the unaccompanied audio. The first correlation function curve may be used to estimate a first delay between the original vocal audio and the unaccompanied audio.

Specifically, the server may acquire a pitch value corresponding to each of a plurality of audio frames included in the original vocal audio, and rank a plurality of acquired pitch values of the original vocal audio according to a sequence of the plurality of audio frames included in the original vocal audio to obtain a first pitch sequence; acquire a pitch value corresponding to each of a plurality of audio frames included in the unaccompanied audio, and rank a plurality of acquired pitch values of the unaccompanied audio according to a sequence of the plurality of audio frames included in the unaccompanied audio to obtain a second pitch sequence; and determine the first correlation function curve based on the first pitch sequence and the second pitch sequence.

It should be noted that usually the audio may be composed of a plurality of audio frames and time intervals between adjacent audio frames are the same. That is, each audio frame corresponds to a time point. In the embodiment of the present disclosure, the server may acquire the pitch value corresponding to each audio frame in the original vocal audio, rank the plurality of pitch values according to a sequence of time points corresponding to the audio frames respectively, and thus obtain the first pitch sequence. The first pitch sequence may also include a time point corresponding to each pitch value. In addition, it should be noted that the pitch value is mainly used to indicate the level of a sound and is an important characteristic of the sound. In the embodiment of the present disclosure, the pitch value is mainly used to indicate a level value of vocals.

Upon acquiring the first pitch sequence, the server may adopt the same method to acquire the pitch value corresponding to each of a plurality of audio frames included in the unaccompanied audio, and rank the plurality of pitch values included in the unaccompanied audio according to a sequence of time points corresponding to the plurality of audio frames included in the unaccompanied audio and thus obtain a second pitch sequence.

After the first pitch sequence and the second pitch sequence are determined, the server may construct a first correlation function model according to the first pitch sequence and the second pitch sequence.

For example, it is assumed that the first pitch sequence is x(n) and the second pitch sequence is y(n), the first correlation function model constructed according to the first pitch sequence and the second pitch sequence may be illustrated by the following formula:

$$c(t) = \sum_{n=-N}^{N} x(n)y(n-t),$$

wherein N is a preset number of pitch values, N is less than or equal to a number of pitch values contained in the first pitch sequence and N is less than or equal to a number of pitch values contained in the second pitch sequence, x(n) denotes an $n^{th}$ pitch value in the first pitch sequence, y(n−t) denotes an $(n-t)^{th}$ pitch value in the second pitch sequence, and t is a time offset between the first pitch sequence and the second pitch sequence.

After the correlation function model is determined, the server may determine the first correlation function curve according to the correlation function model.

It should be noted that the larger N is, the larger the calculation amount is when the server constructs the correlation function model and generates the correlation function curve. In addition, considering characteristics of repeatability and the like of the vocal pitch, in order to avoid the inaccuracy of the correlation function model, the server may take only the first half of the pitch sequence for calculation by setting N.

In step 303, a second correlation function curve is determined based on the original audio and the accompaniment audio.

Both the pitch sequence and the audio sequence are essentially time sequences. For the original vocal audio and the unaccompanied audio, since neither of the audios contains the accompaniment, the server may determine the first correlation function curve of the original vocal audio and the unaccompanied audio by extracting the pitch sequence of the audio. However, for the original audio and the accompaniment audio, since the audios both contain the accompaniment, the server may directly use the plurality of audio frames included in the original audio as a first audio sequence, use the plurality of audio frames included in the accompaniment audio as a second audio sequence, and determine the second correlation function curve based on the first audio sequence and the second audio sequence.

Specifically, the server may construct a second correlation function model according to the first audio sequence and the second audio sequence and generate the second correlation function curve according to the second correlation function model. The mode of the second correlation function model may make reference to the above first correlation function model and is not repeatedly described in the embodiment of the present disclosure.

It should be noted that in the embodiment of the present disclosure, step 302 and step 303 may be performed in a random sequence. That is, the server may perform step 302 firstly and then perform step 303 or the server may perform step 303 firstly and then perform step 302. Nevertheless, the server may perform step 302 and step 303 at the same time.

In step 304, a delay between the accompaniment audio and the unaccompanied audio is corrected based on the first correlation function curve and the second correlation function curve.

After the first correlation function curve and the second correlation function curve are determined, the server may determine a first delay between the original vocal audio and the unaccompanied audio based on the first correlation function curve, determine a second delay between the accompaniment audio and the original audio based on the second correlation function curve, and then correct the delay between the accompaniment audio and the unaccompanied audio based on the first delay and the second delay.

Specifically, the server may detect a first peak on the first correlation function curve, determine the first delay according to t corresponding to the first peak, detect a second peak on the second correlation function curve and determine the second delay according to t corresponding to the second peak.

After the first delay and the second delay are determined, since the first delay is a delay between the original vocal audio and the unaccompanied audio and the original vocal audio is separated from the original audio, the first delay is actually a delay of the unaccompanied audio relative to the vocal in the original audio. The second delay is a delay between the original audio and the accompaniment audio and is actually a delay of the accompaniment audio relative to the original audio. In this case, since both the first delay and the second delay are delays based on the original audio, a delay difference obtained by subtracting the first delay and the second delay is actually the delay between the unaccompanied audio and the accompaniment audio. Based on this, the server may calculate the delay difference between the first delay and the second delay and determine this delay difference as the delay between the accompaniment audio and the unaccompanied audio.

After the delay between the unaccompanied audio and the accompaniment audio is determined, the server may adjust the accompaniment audio or the unaccompanied audio based on this delay and thus align the accompaniment audio with the unaccompanied audio.

Specifically, if the delay between the unaccompanied audio and the accompaniment audio is a negative value, it indicates that the accompaniment audio is later than the unaccompanied audio. At this time, the server may delete audio data in a first period in the accompaniment audio, wherein the start moment of the first period is the start moment of the accompaniment audio, and the duration of the first period is equal to the duration of the delay between the accompaniment audio and the unaccompanied audio. If the delay between the unaccompanied audio and the accompaniment audio is a positive value, it indicates that the accompaniment audio is earlier than the unaccompanied audio. At this time, the server may delete audio data in a second period in the unaccompanied audio, wherein the start moment of the second period is the start moment of the unaccompanied audio, and the duration of the second period is equal to the duration of the delay between the accompaniment audio and the unaccompanied audio.

For example, it is assumed that the accompaniment audio is 2 s later than the unaccompanied audio, the server may delete the audio data within 2 s from the start playing time of the accompaniment audio and thus align the accompaniment audio with the unaccompanied audio.

Optionally, in one possible implementation mode, if the accompaniment audio is later than the unaccompanied audio, the server may also add audio data of the same duration as the delay before the start playing time of the unaccompanied audio. For example, it is assumed that the accompaniment audio is 2 s later than the unaccompanied audio, the server may add audio data of 2 s before the start playing time of the unaccompanied audio and thus align the accompaniment audio with the unaccompanied audio. Added audio data of 2 s may be data that does not contain any audio information.

In the above embodiment, the implementation mode of determining the first delay between the original vocal audio and the unaccompanied audio and the second delay between the original audio and the accompaniment audio is mainly introduced through an autocorrelation algorithm. Optionally, in the embodiment of the present disclosure, in step 302, after the first pitch sequence and the second pitch sequence are determined, the server may determine the first delay between the original vocal audio and the unaccompanied audio through a dynamic time warping algorithm or other delay estimation algorithms; and in step 303, the server may likewise determine the second delay between the original audio and the accompaniment audio through the dynamic time warping algorithm or other delay estimation algorithms. Subsequently, the server may determine the delay difference between the first delay and the second delay as the delay between the unaccompanied audio and the accompaniment audio and correct the unaccompanied audio and the accompaniment audio according to the delay between the unaccompanied audio and the accompaniment audio.

A specific implementation mode of estimating the delay between the two sequences through the dynamic time warping algorithm by the server may make reference to the relevant art, which is not repeatedly described in the embodiment of the present disclosure.

In the embodiment of the present disclosure, the server may acquire the accompaniment audio, the unaccompanied audio and the original audio of the target song, and extract the original vocal audio from the original audio; determine the first correlation function curve based on the original vocal audio and the unaccompanied audio, and determine the second correlation function curve based on the original audio and the accompaniment audio; and correct the delay between the accompaniment audio and the unaccompanied audio based on the first correlation function curve and the second correlation function curve. It can be seen therefrom that in the embodiment of the present disclosure, by processing the accompaniment audio, the unaccompanied audio and the corresponding original audio, the delay between the accompaniment audio and the unaccompanied audio is corrected. Compared with the method for correction by a worker at present, this method saves both labors and time and improves the correction efficiency and also eliminates correction mistakes possibly caused by human factors, thereby improving the accuracy.

An apparatus for correcting a delay between accompaniment audio and unaccompanied audio according to an embodiment of the present disclosure is introduced hereinafter.

Figure 4:
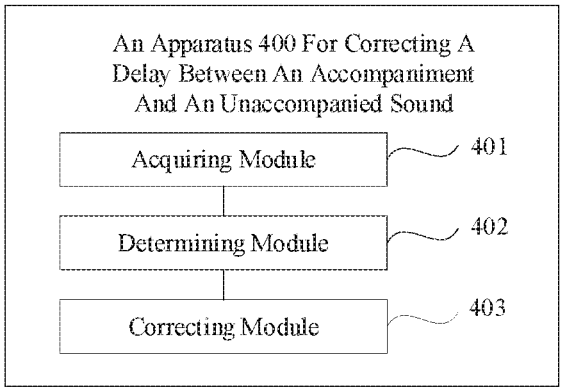
FIG. 4 is a block diagram of an apparatus for correcting a delay between accompaniment audio and unaccompanied audio according to an embodiment of the present disclosure.

With reference to FIG. 4, an embodiment of the present disclosure provides an apparatus 400 for correcting a delay between accompaniment audio and unaccompanied audio. The apparatus 400 includes:

an acquiring module 401, used to acquire accompaniment audio, unaccompanied audio and original audio of a target song, and extract original vocal audio from the original audio;

a determining module 402, used to determine a first correlation function curve based on the original vocal audio and the unaccompanied audio, and determine a second correlation function curve based on the original audio and the accompaniment audio; and a correcting module 403, used to correct a delay between the accompaniment audio and the unaccompanied audio based on the first correlation function curve and the second correlation function curve.

Figure 5:
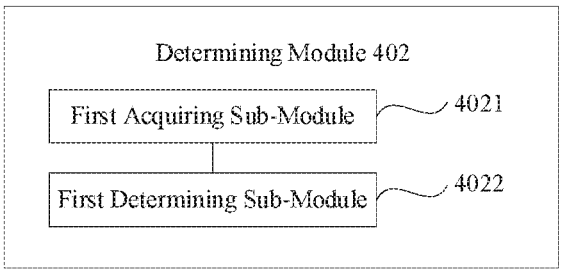
FIG. 5 is a schematic structural diagram of a determining module according to an embodiment of the present disclosure.

Optionally, with reference to FIG. 5, the determining module 402 includes:

a first acquiring sub-module 4021, used to acquire a pitch value corresponding to each of a plurality of audio frames included in the original vocal audio, and rank a plurality of acquired pitch values of the original vocal audio according to a sequence of the plurality of audio frames included in the original vocal audio to obtain a first pitch sequence, wherein the first acquiring sub-module 4021 is further used to acquire a pitch value corresponding to each of a plurality of audio frames included in the unaccompanied audio, and rank a plurality of acquired pitch values of the unaccompanied audio according to a sequence of the plurality of audio frames included in the unaccompanied audio to obtain a second pitch sequence; and a first determining sub-module 4022, used to determine the first correlation function curve based on the first pitch sequence and the second pitch sequence.

Optionally, the first determining sub-module 4022 is used to:

determine, based on the first pitch sequence and the second pitch sequence, a first correlation function model as illustrated by the following formula:

$$c(t) = \sum_{n=-N}^{N} x(n)y(n-t),$$

wherein N is a preset number of pitch values, N is less than or equal to a number of pitch values contained in the first pitch sequence and N is less than or equal to a number of pitch values contained in the second pitch sequence, x(n) denotes an $n^{th}$ pitch value in the first pitch sequence, y(n−t) denotes an $(n-t)^{th}$ pitch value in the second pitch sequence, and t is a time offset between the first pitch sequence and the second pitch sequence; and determine the first correlation function curve based on the first correlation function model.

Optionally, the determining module 402 includes:

a second acquiring sub-module, used to acquire a plurality of audio frames included in the original audio according to a sequence of the plurality of audio frames included in the original audio to obtain a first audio sequence, wherein the second acquiring sub-module is used to acquire a plurality of audio frames included in the accompaniment audio according to a sequence of the plurality of audio frames included in the accompaniment audio to obtain a second audio sequence; and a second determining sub-module, used to determine the second correlation function curve based on the first audio sequence and the second audio sequence.

Figure 6:
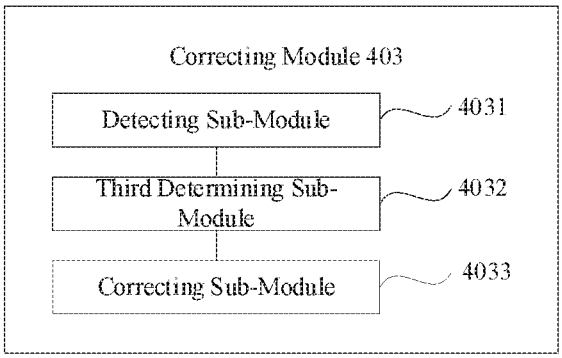
FIG. 6 is a schematic structural diagram of a correcting module according to an embodiment of the present disclosure.

Optionally, with reference to FIG. 6, the correcting module 403 includes:

a detecting sub-module 4031, used to detect a first peak on the first correlation function curve, and detect a second peak on the second correlation function curve;

a third determining sub-module 4032, used to determine a first delay between the original vocal audio and the unaccompanied audio based on the first peak, and determine a second delay between the accompaniment audio and the original audio based on the second peak; and a correcting sub-module 4033, used to correct the delay between the accompaniment audio and the unaccompanied audio based on the first delay and the second delay.

Optionally, the correcting sub-module 4033 is used to:

determine a delay difference between the first delay and the second delay as a delay between the accompaniment audio and the unaccompanied audio;

delete audio data in a first period in the accompaniment audio if the delay between the accompaniment audio and the unaccompanied audio indicates that the accompaniment audio is later than the unaccompanied audio, wherein a start moment of the first period is a start moment of the accompaniment audio, and a duration of the first period is equal to a duration of the delay between the accompaniment audio and the unaccompanied audio; and delete audio data in a second period in the unaccompanied audio if the delay between the accompaniment audio and the unaccompanied audio indicates that the accompaniment audio is earlier than the unaccompanied audio, wherein a start moment of the second period is a start moment of the unaccompanied audio, and a duration of the second period is equal to a duration of the delay between the accompaniment audio and the unaccompanied audio.

In summary, in the embodiment of the present disclosure, the accompaniment audio, the unaccompanied audio and the original audio of the target song are acquired and the original vocal audio is extracted from the original audio; the first correlation function curve is determined based on the original vocal audio and the unaccompanied audio, and the second correlation function curve is determined based on the original audio and the accompaniment audio; and the delay between the accompaniment audio and the unaccompanied audio is corrected based on the first correlation function curve and the second correlation function curve. It can be seen therefrom that in the embodiment of the present disclosure, by processing the accompaniment audio, the unaccompanied audio and the corresponding original audio, the delay between the accompaniment audio and the unaccompanied audio is corrected. Compared with the method for correction by a worker at present, this method saves both labors and time and improves the correction efficiency and also eliminates correction mistakes possibly caused by human factors, thereby improving the accuracy.

It should be noted that when correcting the delay between the accompaniment audio and the unaccompanied audio, the device for correcting the delay between the accompaniment audio and the unaccompanied audio according to the above embodiment is only illustrated by the division of above various functional modules. In practical application, the above functions may be assigned to be completed by different functional modules according to needs, that is, the internal structure of the device is divided into different functional modules to complete all or part of the functions described above. In addition, the device for correcting the delay between the accompaniment audio and the unaccompanied audio according to the above embodiment of the present disclosure and the method embodiment for correcting the delay between the accompaniment audio and the unaccompanied audio belong to the same concept, and a specific implementation process of the device is detailed in the method embodiment and is not repeatedly described here.

Figure 7:
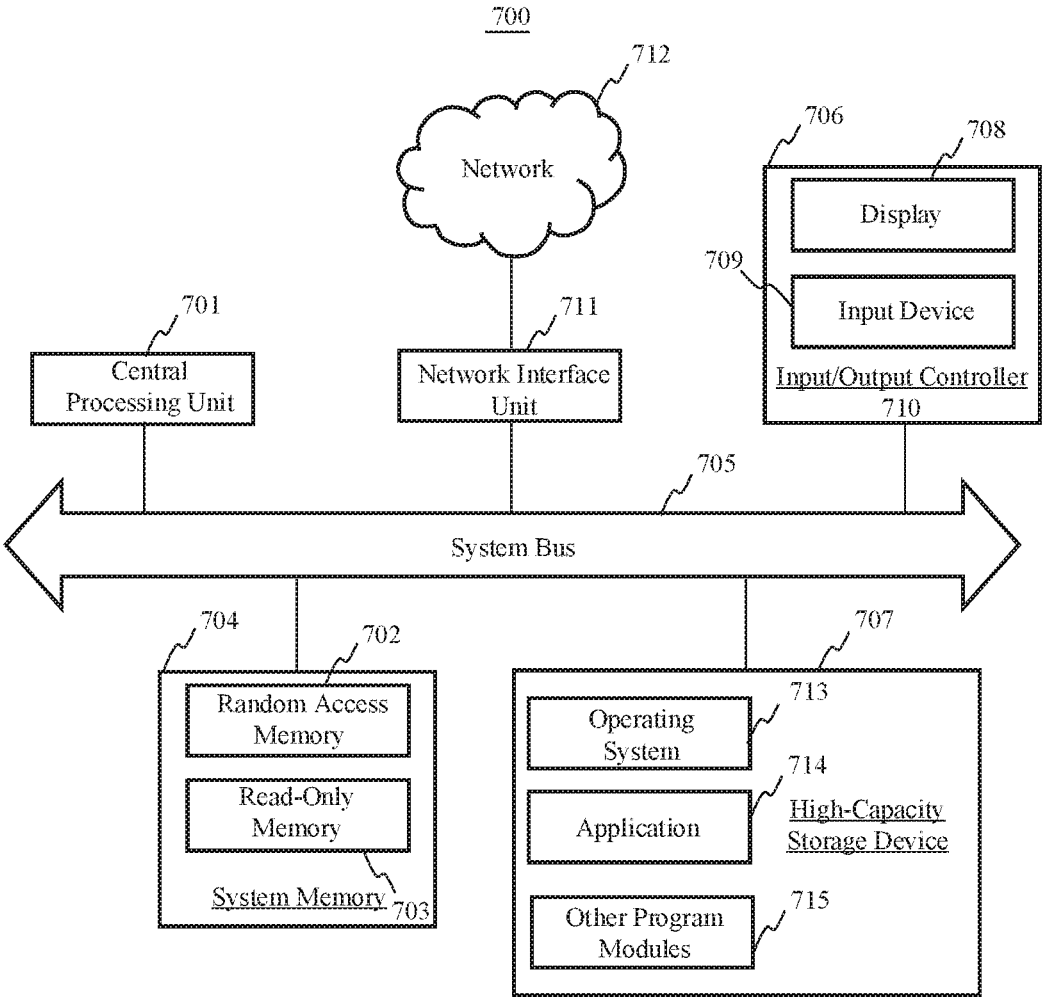
FIG. 7 is a schematic structural diagram of a server for correcting a delay between accompaniment audio and unaccompanied audio according to an embodiment of the present disclosure.

FIG. 7 is a structural diagram of a server of a device for correcting a delay between accompaniment audio and unaccompanied audio according to one exemplary embodiment. The server in the embodiments illustrated in FIG. 2 and FIG. 3 may be implemented through the server illustrated in FIG. 7. The server may be a server in a background server cluster. Specifically, The server 700 includes a central processing unit (CPU) 701, a system memory 704 including a random access memory (RAM) 702 and a read-only memory (ROM) 703, and a system bus 705 connecting the system memory 704 and the central processing unit 701. The server 700 further includes a basic input/output system (I/O system) 706 which helps transport information between various components within a computer, and a high-capacity storage device 707 for storing an operating system 713, an application 714 and other program modules 715.

The basic input/output system 706 includes a display 708 for displaying information and an input device 709, such as a mouse and a keyboard, for inputting information by the user. Both the display 708 and the input device 709 are connected to the central processing unit 701 through an input/output controller 710 connected to the system bus 705. The basic input/output system 706 may also include the input/output controller 710 for receiving and processing input from a plurality of other devices, such as the keyboard, the mouse, or an electronic stylus. Similarly, the input/output controller 710 further provides output to the display, a printer or other types of output devices.

The high-capacity storage device 707 is connected to the central processing unit 701 through a high-capacity storage controller (not illustrated) connected to the system bus 705. The high-capacity storage device 707 and a computer-readable medium associated therewith provide non-volatile storage for the server 700. That is, the high-capacity storage device 707 may include the computer-readable medium (not illustrated), such as a hard disk or a CD-ROM driver.

Without loss of generality, the computer-readable medium may include a computer storage medium and a communication medium. The computer storage medium includes volatile and non-volatile, removable and non-removable media implemented in any method or technology for storage of information such as a computer-readable instruction, a data structure, a program module or other data. The computer storage medium includes a RAM, a ROM, an EPROM, an EEPROM, a flash memory or other solid-state storage technologies, a CD-ROM, DVD or other optical storage, a tape cartridge, a magnetic tape, a disk storage or other magnetic storage devices. Nevertheless, it may be known by a person skilled in the art that the computer storage medium is not limited to above. The above system memory 704 and the high-capacity storage device 707 may be collectively referred to as the memory.

According to various embodiments of the present disclosure, the server 700 may also be connected to a remote computer on a network through the network, such as the Internet, for operation. That is, the server 700 may be connected to the network 712 through a network interface unit 711 connected to the system bus 705, or may be connected to other types of networks or remote computer systems (not illustrated) with the network interface unit 711.

The above memory further includes one or more programs which are stored in the memory, and used to be executed by the CPU. The one or more programs contain at least one instruction for performing the method for correcting delay between the accompaniment audio and the unaccompanied audio according to the embodiment of the present disclosure.

The embodiment of the present disclosure further provides a non-transitory computer-readable storage medium. When being executed by a processor of a server, an instruction in the storage medium causes the server to perform the method for correcting delay between the accompaniment audio and the unaccompanied audio according to the embodiments illustrated in FIG. 2 and FIG. 3.

The embodiment of the present disclosure further provides a computer program product containing an instruction, which, when running on the computer, causes the computer to perform the method for correcting the delay between the accompaniment audio and the unaccompanied audio according to the embodiments illustrated in FIG. 2 and FIG. 3.

It may be understood by an ordinary person skilled in the art that all or part of steps in the method for implementing the above embodiments may be completed by a program instructing relevant hardware. The program may be stored in a computer-readable storage medium such as a ROM/RAM, a magnetic disk, an optical disc or the like.

Described above are merely exemplary embodiments of the present disclosure, and are not intended to limit the present disclosure. Any modifications, equivalent replacements, improvements and the like made within the spirit and principles of the present disclosure shall be considered as falling within the scope of protection of the present disclosure.

What is claimed is:

1. A method for correcting a delay between accompaniment audio and unaccompanied audio, comprising:

acquiring original audio of a target song, and extracting original vocal audio from the original audio;

determining a first delay between the original vocal audio and the unaccompanied audio, and determining a second delay between the accompaniment audio and the original audio; and correcting a delay between the accompaniment audio and the unaccompanied audio based on the first delay and the second delay.

2. The method according to claim 1, wherein determining a first delay between the original vocal audio and the unaccompanied audio comprises:

acquiring a pitch value corresponding to each of a plurality of audio frames contained in the original vocal audio, and ranking a plurality of acquired pitch values of the original vocal audio according to a sequence of the plurality of audio frames contained in the original vocal audio to obtain a first pitch sequence;

acquiring a pitch value corresponding to each of a plurality of audio frames contained in the unaccompanied audio, and ranking a plurality of acquired pitch values of the unaccompanied audio according to a sequence of the plurality of audio frames contained in the unaccompanied audio to obtain a second pitch sequence; and determining a first correlation function curve based on the first pitch sequence and the second pitch sequence, wherein the first delay between the original vocal audio and the unaccompanied audio is determined based on a first peak detected on the first correlation function curve.

3. The method according to claim 2, wherein determining a first correlation function curve based on the first pitch sequence and the second pitch sequence comprises:

determining, based on the first pitch sequence and the second pitch sequence, a first correlation function model as illustrated by the following formula:

$$c(t) = \sum_{n=-N}^{N} x(n)y(n-t),$$

wherein N is a number of pitch values, N is less than or equal to a number of pitch values contained in the first pitch sequence and N is less than or equal to a number of pitch values contained in the second pitch sequence, x(n) is an $n^{th}$ pitch value in the first pitch sequence, y(n−t) is an $(n-t)^{th}$ pitch value in the second pitch sequence, and t is a time offset between the first pitch sequence and the second pitch sequence, and wherein the first correlation function curve is determined based on the first correlation function model.

4. The method according to claim 1, wherein determining a second delay between the accompaniment audio and the original audio comprises:

acquiring a plurality of audio frames contained in the original audio according to a sequence of the plurality of audio frames contained in the original audio to obtain a first audio sequence;

acquiring a plurality of audio frames contained in the accompaniment audio according to a sequence of the plurality of audio frames contained in the accompaniment audio to obtain a second audio sequence; and determining the a second correlation function curve based on the first audio sequence and the second audio sequence, wherein the second delay between the accompaniment audio and the original audio is determined based on a second peak detected on the second correlation function curve.

5. The method according to claim 1, wherein the correcting the delay between the accompaniment audio and the unaccompanied audio based on the first delay and the second delay comprises:

determining a delay difference between the first delay and the second delay as a delay between the accompaniment audio and the unaccompanied audio;

deleting audio data in a first period in the accompaniment audio if the delay between the accompaniment audio and the unaccompanied audio indicates that the accompaniment audio is later than the unaccompanied audio, wherein a start moment of the first period is a start moment of the accompaniment audio, and a duration of the first period is equal to a duration of the delay between the accompaniment audio and the unaccompanied audio; and deleting audio data in a second period in the unaccompanied audio if the delay between the accompaniment audio and the unaccompanied audio indicates that the accompaniment audio is earlier than the unaccompanied audio, wherein a start moment of the second period is a start moment of the unaccompanied audio, and a duration of the second period is equal to a duration of the delay between the accompaniment audio and the unaccompanied audio.

6. An apparatus for correcting a delay between accompaniment audio and unaccompanied audio, comprising:

an acquiring module, configured to acquire accompaniment audio, unaccompanied audio and original audio of a target song, and extract original vocal audio from the original audio;

a determining module, configured to determine a first correlation function curve based on the original vocal audio and the unaccompanied audio, and determine a second correlation function curve based on the original audio and the accompaniment audio; and a correcting module, configured to correct a delay between the accompaniment audio and the unaccompanied audio based on the first correlation function curve and the second correlation function curve.

7. The apparatus according to claim 6, wherein the determining module comprises:

a first acquiring sub-module, configured to acquire a pitch value corresponding to each of a plurality of audio frames contained in the original vocal audio, and rank the plurality of acquired pitch values of the original vocal audio according to a sequence of the plurality of audio frames contained in the original vocal audio to obtain a first pitch sequence, wherein the first acquiring sub-module is further configured to acquire a pitch value corresponding to each of a plurality of audio frames contained in the unaccompanied audio, and rank a plurality of acquired pitch values of the unaccompanied audio according to a sequence of the plurality of audio frames contained in the unaccompanied audio to obtain a second pitch sequence, a first determining sub-module, in which the first correlation function curve is determined based on the first pitch sequence and the second pitch sequence.

8. The apparatus according to claim 7, wherein the first determining sub-module is configured to:

determine, based on the first pitch sequence and the second pitch sequence, a first correlation function model as illustrated by the following formula:

$$c(t) = \sum_{n=-N}^{N} x(n)y(n-t),$$

wherein N is a number of pitch values, N is less than or equal to a number of pitch values contained in the first pitch sequence and N is less than or equal to a number of pitch values contained in the second pitch sequence, x(n) is an $n^{th}$ pitch value in the first pitch sequence, y(n−t) is an $(n-t)^{th}$ pitch value in the second pitch sequence, and t is a time offset between the first pitch sequence and the second pitch sequence, and wherein the first correlation function curve is determined based on the first correlation function model.

9. The apparatus according to claim 6 wherein the correcting module comprises:

a detecting sub-module, configured to detect a first peak on the first correlation function curve, and detect a second peak on the second correlation function curve;

a third determining sub-module, configured to determine a first delay between the original vocal audio and the unaccompanied audio based on the first peak, and determine a second delay between the accompaniment audio and the original audio based on the second peak; and a correcting sub-module, configured to correct the delay between the accompaniment audio and the unaccompanied audio based on the first delay and the second delay.

10. The apparatus according to claim 9, wherein the correcting sub-module is configured to:

determine a delay difference between the first delay and the second delay as a delay between the accompaniment audio and the unaccompanied audio;

delete audio data in a second period in the unaccompanied audio if the delay between the accompaniment audio and the unaccompanied audio indicates that the accompaniment audio is later than the unaccompanied audio, wherein a start moment of the second period is a start moment of the unaccompanied audio, and a duration of the second period is equal to a duration of the delay between the accompaniment audio and the unaccompanied audio; and delete audio data in a second period in the unaccompanied audio if the delay between the accompaniment audio and the unaccompanied audio indicates that the accompaniment audio is earlier than the unaccompanied audio, wherein a start moment of the second period is a start moment of the unaccompanied audio, and a duration of the second period is equal to a duration of the delay between the accompaniment audio and the unaccompanied audio.

11. An apparatus for correcting a delay between accompaniment audio and an unaccompanied audio, comprising:

a processor; and a memory configured to store processor-executable instructions that, when executed by the processor, cause the processor to implement a method comprising:

acquiring original audio of a target song, and extracting original vocal audio from the original audio;

determining a first delay between the original vocal audio and the unaccompanied audio, and determining a second delay between the accompaniment audio and the original audio; and correcting a delay between the accompaniment audio and the unaccompanied audio based on the first delay and the second delay.

12. A non-transitory computer-readable storage medium storing instructions that, when being executed by a processor, causes the processor to implement the method according to claim 1.

13. The apparatus according to claim 11, wherein determining a first delay between the original vocal audio and the unaccompanied audio comprises:

acquiring a pitch value corresponding to each of a plurality of audio frames contained in the original vocal audio, and ranking a plurality of acquired pitch values of the original vocal audio according to a sequence of the plurality of audio frames contained in the original vocal audio to obtain a first pitch sequence;

acquiring a pitch value corresponding to each of a plurality of audio frames contained in the unaccompanied audio, and ranking a plurality of acquired pitch values of the unaccompanied audio according to a sequence of the plurality of audio frames contained in the unaccompanied audio to obtain a second pitch sequence; and determining a first correlation function curve based on the first pitch sequence and the second pitch sequence, wherein the first delay between the original vocal audio and the unaccompanied audio is determined based on a first peak detected on the first correlation function curve.

14. The apparatus according to claim 13, wherein determining a first correlation function curve based on the first pitch sequence and the second pitch sequence comprises:

determining, based on the first pitch sequence and the second pitch sequence, a first correlation function model as illustrated by the following formula:

$$c(t) = \sum_{n=-N}^{N} x(n)y(n-t),$$

wherein N is a number of pitch values, N is less than or equal to a number of pitch values contained in the first pitch sequence and N is less than or equal to a number of pitch values contained in the second pitch sequence, x(n) is an $n^{th}$ pitch value in the first pitch sequence, y(n−t) is an $(n-t)^{th}$ pitch value in the second pitch sequence, and t is a time offset between the first pitch sequence and the second pitch sequence, wherein the first correlation function curve is determined based on the first correlation function model.

15. The apparatus according to claim 11, wherein determining a second delay between the accompaniment audio and the original audio comprises:

acquiring a plurality of audio frames contained in the original audio according to a sequence of the plurality of audio frames contained in the original audio to obtain a first audio sequence;

acquiring a plurality of audio frames contained in the accompaniment audio according to a sequence of the plurality of audio frames contained in the accompaniment audio to obtain a second audio sequence; and determining a second correlation function curve based on the first audio sequence and the second audio sequence, wherein the second delay between the accompaniment audio and the original audio is determined based on a second peak detected on the second correlation function curve.

16. The apparatus according to claim 11, wherein the correcting the delay between the accompaniment audio and the unaccompanied audio based on the first delay and the second delay comprises:

determining a delay difference between the first delay and the second delay as a delay between the accompaniment audio and the unaccompanied audio;

deleting audio data in a first period in the accompaniment audio if the delay between the accompaniment audio and the unaccompanied audio indicates that the accompaniment audio is later than the unaccompanied audio, wherein a start moment of the first period is a start moment of the accompaniment audio, and a duration of the first period is equal to a duration of the delay between the accompaniment audio and the unaccompanied audio; and deleting audio data in a second period in the unaccompanied audio if the delay between the accompaniment audio and the unaccompanied audio indicates that the accompaniment audio is earlier than the unaccompanied audio, wherein a start moment of the second period is a start moment of the unaccompanied audio, and a duration of the second period is equal to a duration of the delay between the accompaniment audio and the unaccompanied audio.

17. The storage medium according to claim 12, wherein determining a first delay between the original vocal audio and the unaccompanied audio comprises:

acquiring a pitch value corresponding to each of a plurality of audio frames contained in the original vocal audio, and ranking a plurality of acquired pitch values of the original vocal audio according to a sequence of the plurality of audio frames contained in the original vocal audio to obtain a first pitch sequence;

acquiring a pitch value corresponding to each of a plurality of audio frames contained in the unaccompanied audio, and ranking a plurality of acquired pitch values of the unaccompanied audio according to a sequence of the plurality of audio frames contained in the unaccompanied audio to obtain a second pitch sequence;

determining a first correlation function curve based on the first pitch sequence and the second pitch sequence; and determining the first delay between the original vocal audio and the unaccompanied audio based on a first peak detected on the first correlation function curve.

18. The storage medium according to claim 17, wherein determining a first correlation function curve based on the first pitch sequence and the second pitch sequence comprises:

determining, based on the first pitch sequence and the second pitch sequence, a first correlation function model as illustrated by the following formula:

$$c(t) = \sum_{n=-N}^{N} x(n)y(n-t),$$

wherein N is a number of pitch values, N is less than or equal to a number of pitch values contained in the first pitch sequence and N is less than or equal to a number of pitch values contained in the second pitch sequence, x(n) is an $n^{th}$ pitch value in the first pitch sequence, y(n−t) is an $(n-t)^{th}$ pitch value in the second pitch sequence, and t is a time offset between the first pitch sequence and the second pitch sequence; and determining the first correlation function curve based on the first correlation function model.

19. The storage medium according to claim 12, wherein determining a second delay between the accompaniment audio and the original audio comprises:

acquiring a plurality of audio frames contained in the original audio according to a sequence of the plurality of audio frames contained in the original audio to obtain a first audio sequence;

acquiring a plurality of audio frames contained in the accompaniment audio according to a sequence of the plurality of audio frames contained in the accompaniment audio to obtain a second audio sequence; and determining a second correlation function curve based on the first audio sequence and the second audio sequence, wherein the second delay between the accompaniment audio and the original audio is determined based on a second peak detected on the second correlation function curve.

20. The storage medium according to claim 12, wherein the correcting the delay between the accompaniment audio and the unaccompanied audio based on the first delay and the second delay comprises:

determining a delay difference between the first delay and the second delay as a delay between the accompaniment audio and the unaccompanied audio;

deleting audio data in a first period in the accompaniment audio if the delay between the accompaniment audio and the unaccompanied audio indicates that the accompaniment audio is later than the unaccompanied audio, wherein a start moment of the first period is a start moment of the accompaniment audio, and a duration of the first period is equal to a duration of the delay between the accompaniment audio and the unaccompanied audio; and deleting audio data in a second period in the unaccompanied audio if the delay between the accompaniment audio and the unaccompanied audio indicates that the accompaniment audio is earlier than the unaccompanied audio, wherein a start moment of the second period is a start moment of the unaccompanied audio, and a duration of the second period is equal to a duration of the delay between the accompaniment audio and the unaccompanied audio.

* * * * *